US011649937B1

(12) United States Patent
Chen

(10) Patent No.: US 11,649,937 B1
(45) Date of Patent: May 16, 2023

(54) DECORATIVE LIGHT APPLICABLE TO LANDSCAPING

(71) Applicant: ZHU HAI FUYUN LIGHTING INDUSTRIAL CO., LTD., Zhuhai (CN)

(72) Inventor: Su-Hua Chen, Zhuhai (CN)

(73) Assignee: ZHU HAI FUYUN LIGHTING INDUSTRIAL CO., LTD., Zhuhai (CN)

( * ) Notice: Subject to any disclaimer, the term of this patent is extended or adjusted under 35 U.S.C. 154(b) by 0 days.

(21) Appl. No.: 17/864,843

(22) Filed: Jul. 14, 2022

(51) Int. Cl.
*F21S 4/28* (2016.01)
*F21Y 115/10* (2016.01)
*F21W 121/00* (2006.01)

(52) U.S. Cl.
CPC ..... *F21S 4/28* (2016.01); *F21W 2121/00* (2013.01); *F21Y 2115/10* (2016.08)

(58) Field of Classification Search
CPC ..... F21S 4/28; F21Y 2115/10
See application file for complete search history.

(56) References Cited

U.S. PATENT DOCUMENTS 3,885,616 A * 5/1975 Berkowitz ..... E06B 9/0623 160/215
4,669,521 A * 6/1987 Barnes ..... E06B 9/0623 160/136
10,161,601 B1 * 12/2018 Chen ..... F21S 6/00
11,098,861 B1 * 8/2021 Wang ..... A45B 23/00
2017/0342768 A1 * 11/2017 Zwierzykowski .... E01F 13/022
2021/0123241 A1 * 4/2021 Meyer ..... E04H 17/1417

* cited by examiner

*Primary Examiner* — Evan P Dzierzynski
(74) *Attorney, Agent, or Firm* — Rabin & Berdo, P.C.

(57) ABSTRACT

A decorative light applicable for landscaping includes an expandable and collapsible main body and a lighting portion. The main body includes a plurality of first elongated members and a plurality of second elongated members that are pivotally connected to and overlap the first elongated members. The main body is expandable and collapsible between its two opposite lateral sides through pivotal movement of the first and the second elongated members. The lighting portion includes a power supply unit and a plurality of light strings. The light strings are electrically connected to the power supply unit and extend into the first and the second elongated members respectively. Each light string is provided with a plurality of light-emitting diode (LED) lamp beads that are arranged at intervals.

20 Claims, 8 Drawing Sheets

DECORATIVE LIGHT APPLICABLE TO LANDSCAPING

BACKGROUND OF THE INVENTION

1. Technical Field

The present invention relates to a decorative light for adorning the environment and more particularly to a decorative light that is applicable to landscaping and can be used for defining a spatial layout.

2. Description of Related Art

On holidays such as the New Year holidays, lights and/or ornaments are typically used to decorate the environment and add to the festive atmosphere. As people's quality of life, taste, or preferences have changed over time, those traditional decorative objects that are dull and monotonous have gradually failed to meet users' needs. This explains why novel decorative light products that are easy to deploy have in recent years been more and more popular and are now in extensive use. However, most of the existing decorative light products have a single function only and serve no other purposes than to provide decorative lighting. In other words, the conventional decorative lights still leave much to be desired and need further improvement.

BRIEF SUMMARY OF THE INVENTION

In view of the aforesaid deficiency of the prior art, the present invention provides a decorative light that is applicable to landscaping. In addition to producing a decorative lighting effect, the decorative light of the invention can be used to define a spatial layout and therefore has multiple applications and different uses.

The present invention incorporates an expandable design into a simple structure so that the decorative light of the invention can be expanded as needed to an appropriate width during use and collapsed to the smallest volume when not in use, thereby providing great convenience of use and reducing storage-related problems. Moreover, when in the collapsed state, some decorative portions of the decorative light can form a gripping portion that can be easily gripped to facilitate carrying and use.

To achieve the aforesaid and other objectives and effects, the major structural features of, and the technical means adopted by, the present invention include an expandable and collapsible main body and a lighting portion. The main body includes a plurality of first elongated members that are arranged parallel to one another and a plurality of second elongated members that are also arranged parallel to one another. Each second elongated member as well as each first elongated member has a hollow interior. The first elongated members are arranged obliquely with respect to, and overlap, the second elongated members. Moreover, the first elongated members and the second elongated members are pivotally connected by a plurality of pivot shaft members and can therefore be moved pivotally and slantingly with respect to each other, thereby allowing the main body to be expandable and collapsible between its two opposite lateral sides. The lighting portion includes a power supply unit and a plurality of light strings. The light strings are electrically connected to the power supply unit and extend into the first elongated members and the second elongated members respectively. Each light string is provided with a plurality of light-emitting diode (LED) lamp beads that are arranged at intervals.

The foregoing structures may be so configured that a top portion of at least one of the first elongated members is connected or extended with a rotatable first handle, that a top portion of at least one of the second elongated members is connected or extended with a rotatable second handle, and that when the main body is in a collapsed state, the first handle and the second handle can be rotated to jointly form a gripping portion.

The foregoing structures may be so configured that each first elongated member is pivotally connected to at least two adjacent ones of the second elongated members, and that each second elongated member is pivotally connected to at least two adjacent ones of the first elongated members.

The foregoing structures may be so configured that each second elongated member as well as each first elongated member is provided with a top cover for sealing the top end of the elongated member, and that each top cover has an inner side provided with a positioning portion for securing the corresponding light string.

The foregoing structures may be so configured that the second handle as well as the first handle has a hollow interior, that the first handle is connected between the corresponding first elongated member and the top cover of the corresponding first elongated member, and that the second handle is connected between the corresponding second elongated member and the top cover of the corresponding second elongated member.

The foregoing structures may be so configured that each second elongated member as well as each first elongated member is provided with a bottom sleeve coupled to the bottom end of the elongated member, and that each bottom sleeve is formed with a lateral guide groove through which the corresponding light string can pass.

The foregoing structures may be so configured that each bottom sleeve is further provided with a joining portion for connecting with a stake.

The foregoing structures may be so configured that each stake includes a joining section and an extension section, that each joining section is configured to be coupled to the joining portion of one of the bottom sleeves, and that each extension section extends from the corresponding joining section at an inclination angle so that the extension sections of a plurality of stakes connected to the main body can be generally parallel to one another when the main body is in an expanded state.

The foregoing structures may be so configured that the inclination angle between each extension section and the corresponding joining section is about 30 degrees, and that each stake has two opposite laterals sides each extended with a lateral wing.

The foregoing structures may be so configured that the lighting portion further includes an external electrical cable connected to the power supply unit, and that each light string is electrically connected to the power supply unit through the external electrical cable.

The foregoing structures may be so configured that the first handle and the second handle are symmetrically located and are close to the two opposite lateral sides of the main body respectively, and that each of the first handle and the second handle includes an arcuate section that curves backward.

The foregoing structures may be so configured that the LED lamp beads of each light string are configured to emit light in a continuous or flashing manner when activated.

The foregoing structures may be so configured that the outer surface of each second elongated member as well as of each first elongated member is provided with a design of at least two colors.

BRIEF DESCRIPTION OF THE SEVERAL VIEWS OF THE DRAWINGS

The aforesaid and other objectives, effects, and features of the present invention can be better understood by referring to the following detailed description of some preferred embodiments of the invention in conjunction with the accompanying drawings, in which.

DETAILED DESCRIPTION OF THE INVENTION

Figure 1:
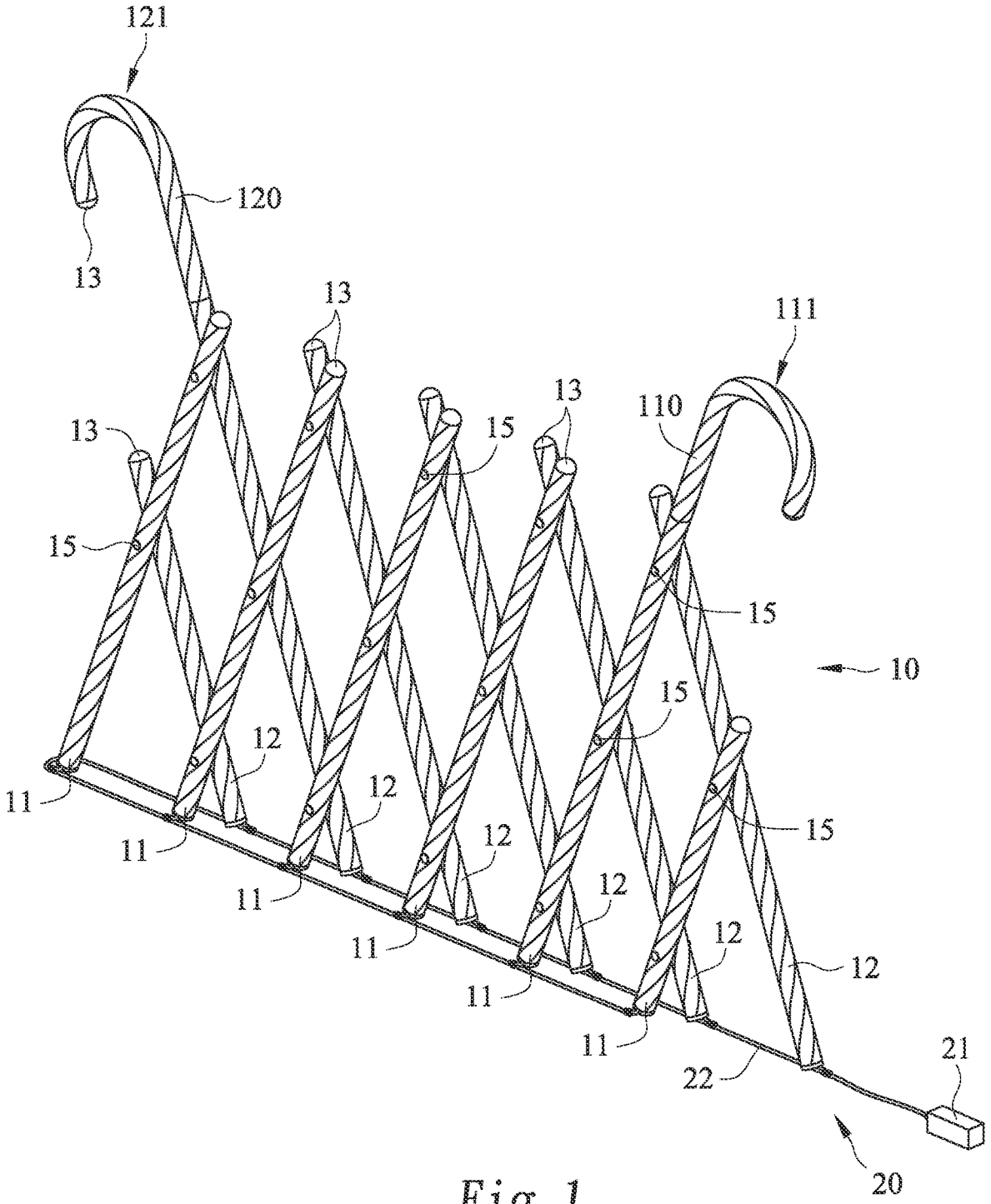
FIG. 1 is a perspective view of an embodiment of the invention.

Referring to FIG. 1, the decorative light applicable to landscaping according to an embodiment of the present invention essentially includes two parts, namely a main body 10 and a lighting portion 20.

Figure 2:
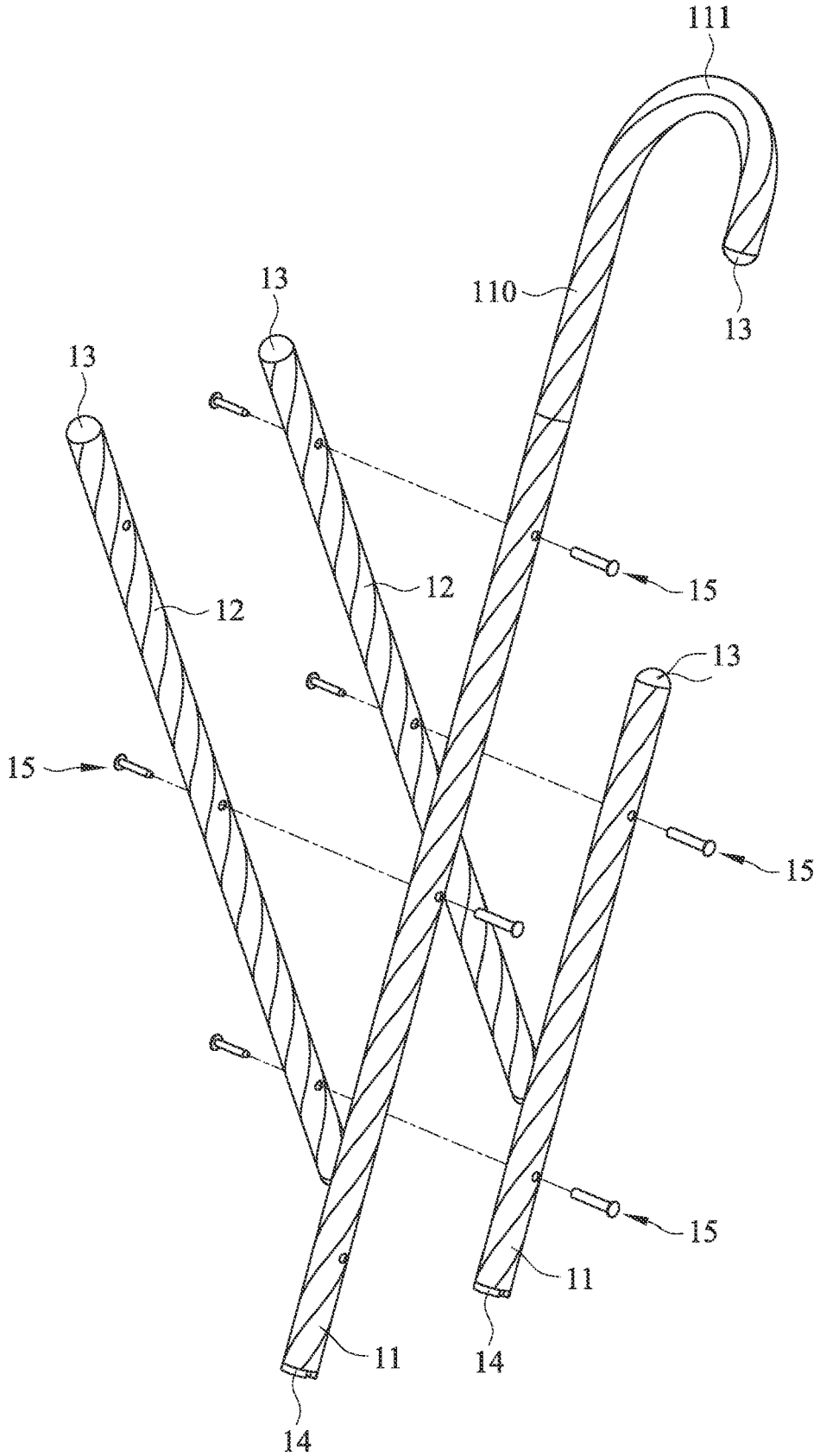
FIG. 2 is a partial exploded view of the main body in an embodiment of the invention.

The main body 10 is an expandable and collapsible structure assembled from a plurality of first elongated members 11 and a plurality of second elongated members 12. Referring also to FIG. 2, the first elongated members 11 are arranged parallel to one another, and so are the second elongated members 12. The first elongated members 11 are arranged obliquely with respect to, and overlap, the second elongated members 12. Moreover, the first elongated members 11 and the second elongated members 12 are pivotally connected by a plurality of pivot shaft members 15 so as to be movable with respect to each other in a pivotal and slanting manner (while maintaining mirror symmetry in tilt between the first elongated members 11 and the second elongated members 12). Thus, the main body 10 forms a grating structure that can be expanded and collapsed between its two opposite lateral sides.

In this embodiment, each first elongated member 11 is pivotally connected to at least two adjacent ones of the second elongated members 12, and each second elongated member 12 is pivotally connected to at least two adjacent ones of the first elongated members 11. Each pivot shaft member 15 used to provide pivotal connection may be a pivot shaft composed of a male rivet and a female rivet that are inserted through the corresponding first and second elongated members 11 and 12 from the outer sides thereof respectively and then coupled together to form a secure structure with respect to which the corresponding first and second elongated members 11 and 12 can pivot.

Figure 3A:
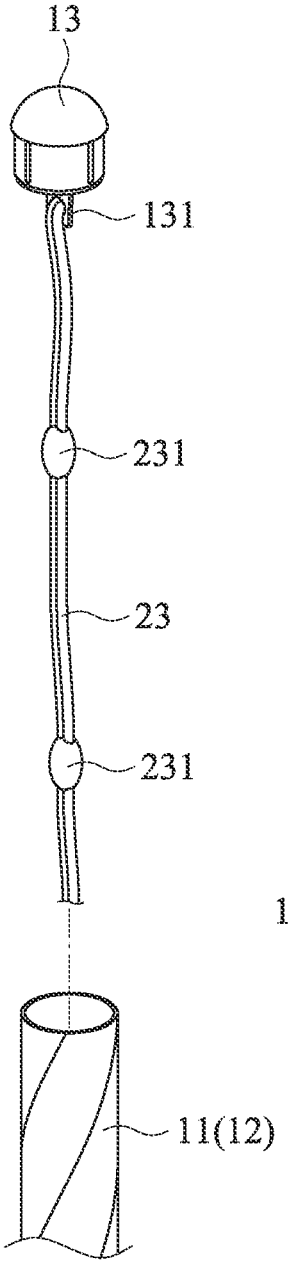
FIG. 3A and FIG. 3B show two different structures of the top end of each first or second elongated member in an embodiment of the invention.
Figure 3B:
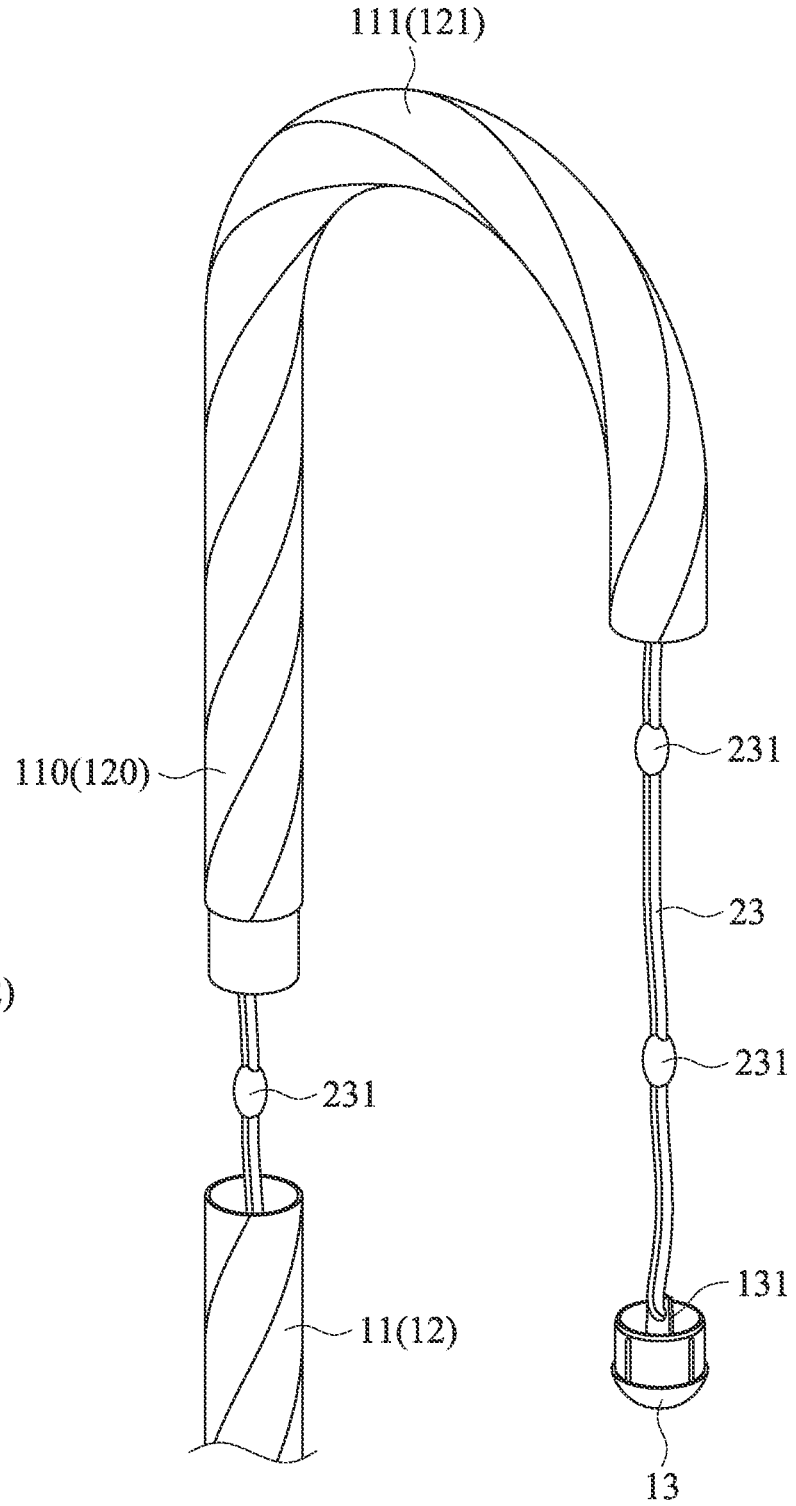
Figure 3C:
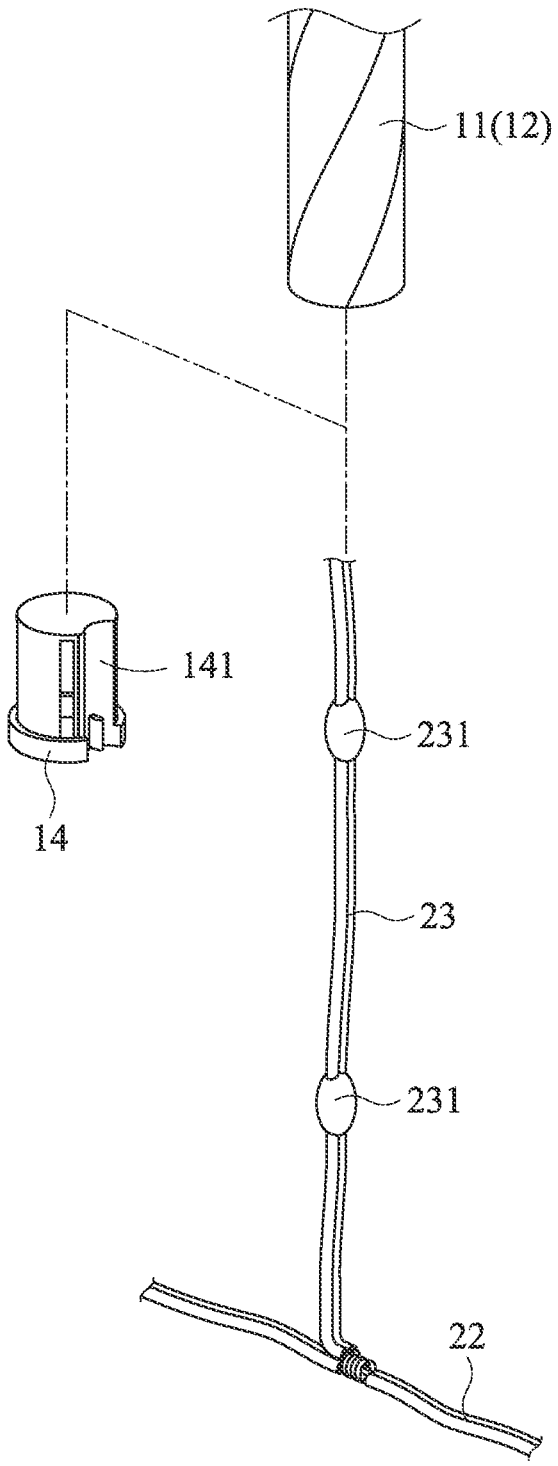
FIG. 3C shows the structure of the bottom end of each first or second elongated member in an embodiment of the invention.

In this embodiment, referring to FIG. 3A to FIG. 3C, each first elongated member 11 and each second elongated member 12 are circular tubes with a hollow interior and may be made of a light-permeable or light-diffusing material. The lighting portion 20 includes a power supply unit 21, an external electrical cable 22, and a plurality of light strings 23. The power supply unit 21 may have such components as a switch, a controller, and an electricity storage unit. The external electrical cable 22 is connected to the power supply unit 21 and passes sequentially through the bottom ends of the first elongated members 11 and of the second elongated members 12. The light strings 23 are connected to the external electrical cable 22 separately and are electrically connected to the power supply unit 21 through the external electrical cable 22. Furthermore, the light strings 23, which are connected to the external electrical cable 22 separately, extend into the first elongated members 11 and the second elongated members 12 respectively.

As shown in FIG. 3C, each second elongated member 12 as well as each first elongated member 11 is connected with a bottom sleeve 14 at the bottom end. Each bottom sleeve 14 is formed with a lateral guide groove 141 through which the corresponding light string 23 can pass in order to enter the corresponding first or second elongated member 11 or 12.

As shown in FIG. 3A, each second elongated member 12 as well as each first elongated member 11 is connected with a top cover 13 at the top end. Each top cover 13 is configured to seal the top end of the corresponding tube. In addition, the inner side of each top cover 13 is provided with a positioning portion 131 for securing an end portion of the corresponding light string 23 so that the corresponding light string 23 can extend from the bottom end of the corresponding first or second elongated member 11 or 12 all the way to the top end, thereby allowing the LED lamp beads 231 of the corresponding light string 23 to be distributed at intervals in a generally even manner in the corresponding first or second elongated member 11 or 12.

Figure 4:
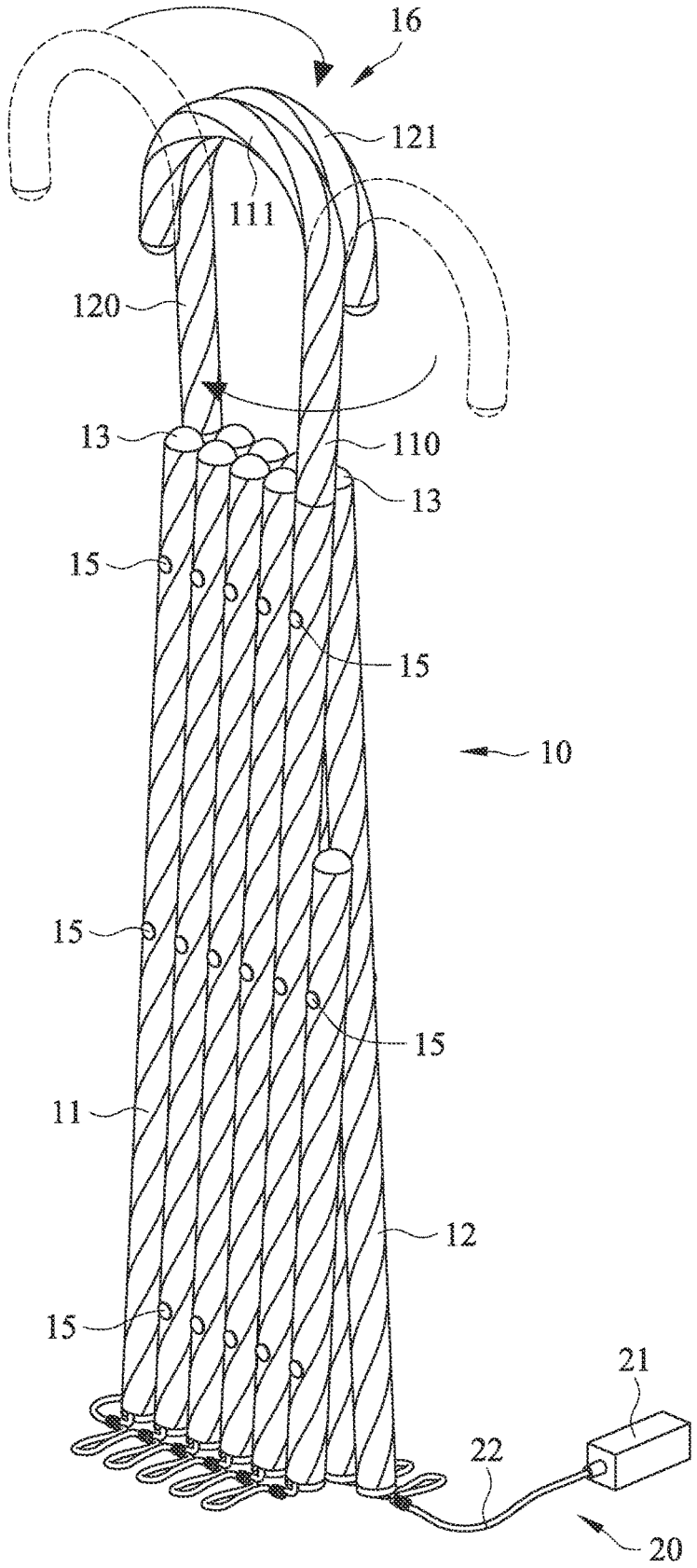
FIG. 4 shows the main body in an embodiment of the invention in a collapsed state.

Furthermore, as shown in FIG. 1, this embodiment is so designed that one of the first elongated members 11 is close to one of the two opposite lateral sides of the main body 10 and has a top portion connected or extended with a rotatable first handle 110, and that one of the second elongated members 12 is close to the other of the two opposite lateral sides of the main body 10 and has a top portion connected or extended with a rotatable second handle 120. The first handle 110 and the second handle 120 are symmetrically located at two opposite lateral positions of the main body 10 respectively and include backwardly curved arcuate sections 111 and 121 respectively. When the main body 10 is in a collapsed state as shown in FIG. 4, the first handle 110 and the second handle 120 can be rotated in order to overlap, be close to, or abut against each other or form other configurations in which the two handles jointly define a gripping portion 16 that can be easily gripped. The gripping portion 16 allows the decorative light of the present invention to be lifted and/or moved around with ease.

As shown in FIG. 3B, the first handle 110 is a tube with a hollow interior and is connected between the corresponding first elongated member 11 and the top cover 13 of the corresponding first elongated member 11. Likewise, the second handle 120 is a tube with a hollow interior and is connected between the corresponding second elongated member 12 and the top cover 13 of the corresponding second elongated member 12. Each of the first handle 110 and the second handle 120, therefore, allows passage of the corresponding light string 23 so that the corresponding LED lamp beads 231 of the corresponding light string 23 can be distributed in the handle.

Figure 5:
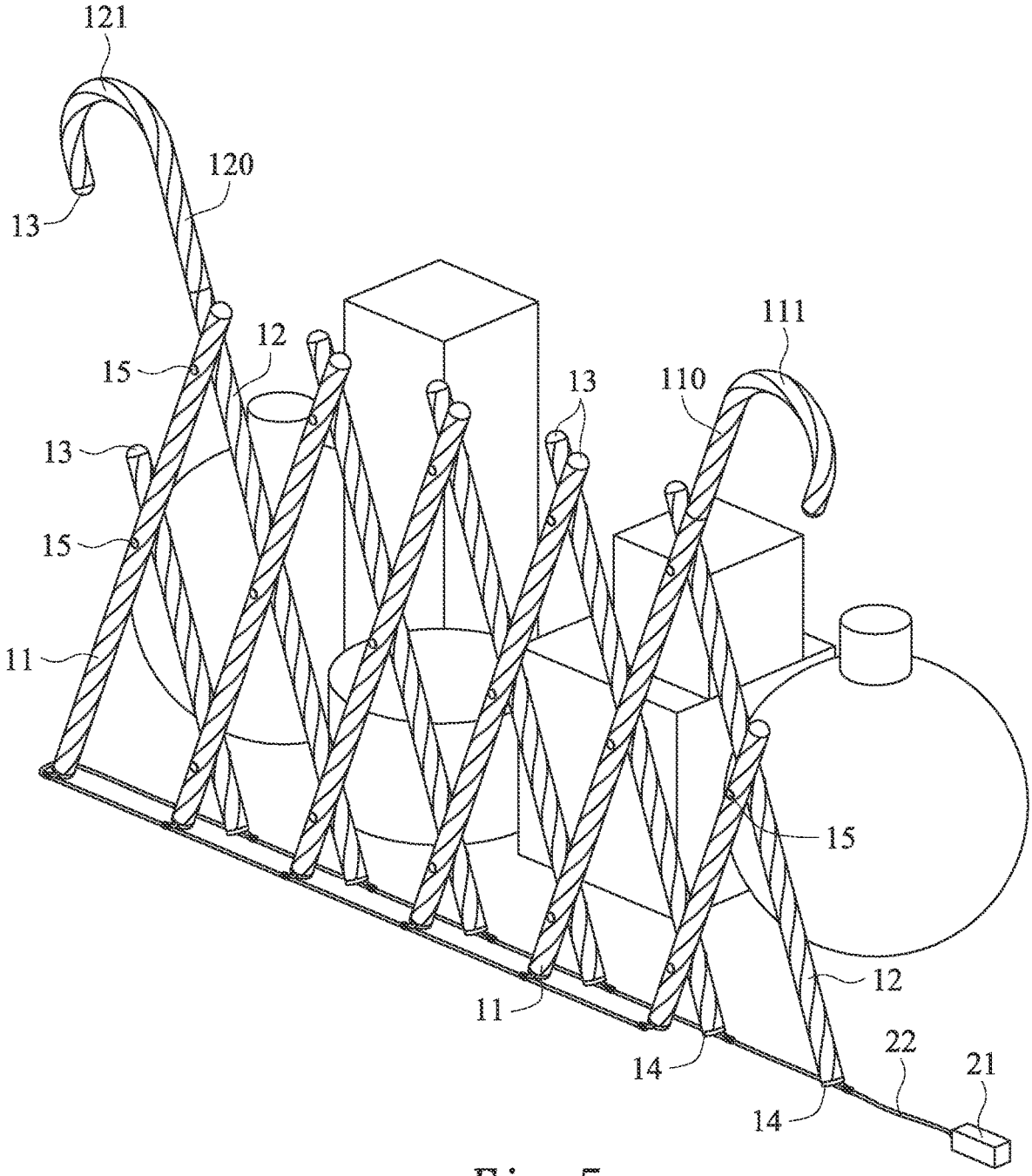
FIG. 5 shows the main body in an embodiment of the invention in an expanded state for use.

In terms of use of this embodiment, referring to FIG. 4 and FIG. 5, the main body 10 can be pivoted into the collapsed state (see FIG. 4) when not in use, thereby allowing the user to move the decorative light easily by the gripping portion 16 and store the decorative light in the collapsed state, i.e., in a small-volume configuration. To use, the main body 10 can be pivoted into an expanded state (see FIG. 5) and then used to define a spatial layout. The main body 10 itself also provides a lighting and decorative effect. Thus, embodiment enables new and diversified applications and arrangement.

In one feasible embodiment, the lighting portion 20 is equipped with an appropriate control mechanism so that when the lighting portion 20 is activated, the LED lamp beads 231 of the light strings 23 can emit light in, for example, a continuous manner and/or a flashing manner. Moreover, the outer surface of each second elongated member 12 as well as of each first elongated member 11 may be provided with a different pattern or different stripes as needed. In this embodiment, the outer surface of each second elongated member 12 as well as of each first elongated member 11 is provided with stripes similar to those on a candy crane, i.e., with stripes of a first color alternating with stripes of a second color.

Figure 6:
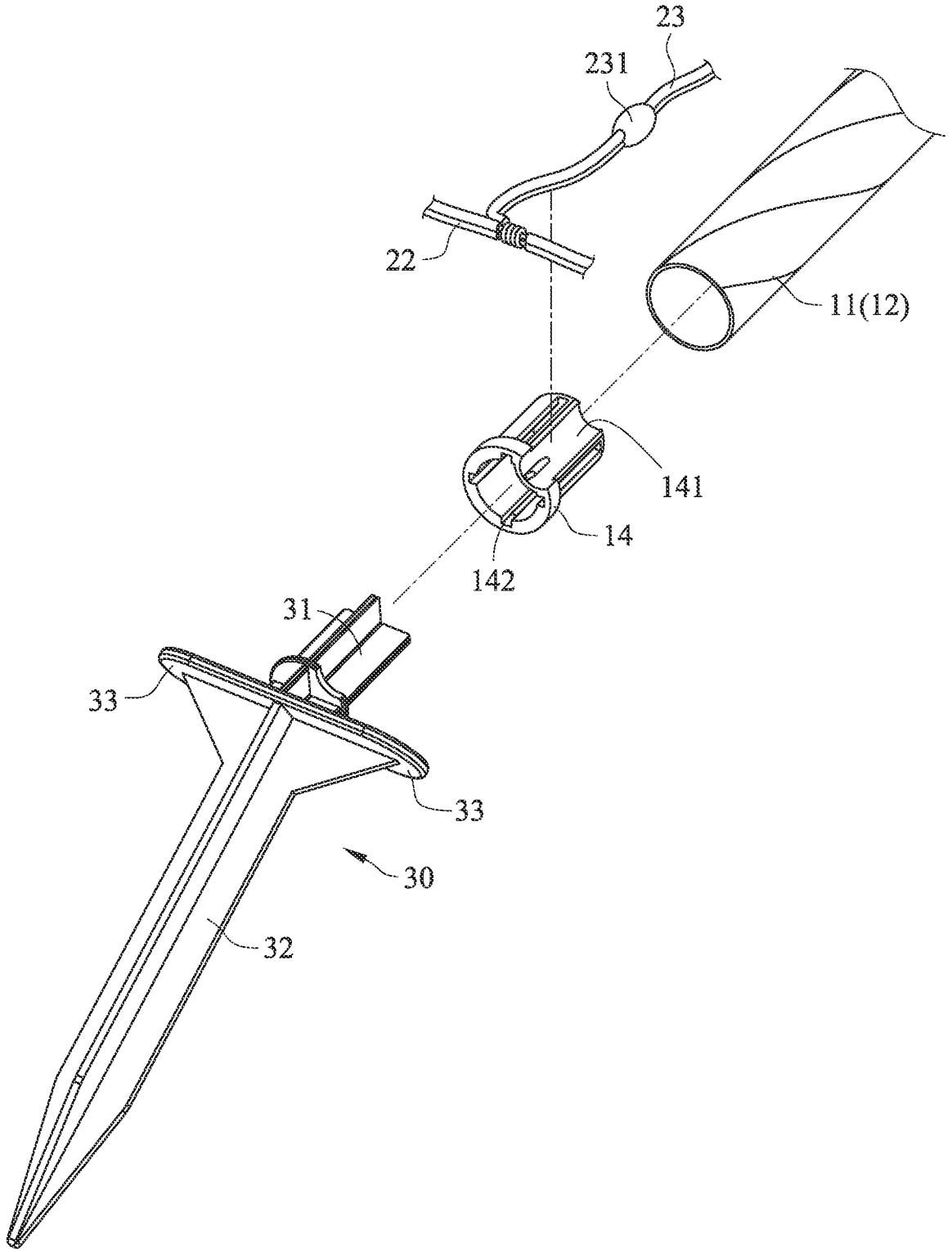
FIG. 6 is an exploded view showing how a stake is connected to the bottom end of each first or second elongated member in an embodiment of the invention.
Figure 7:
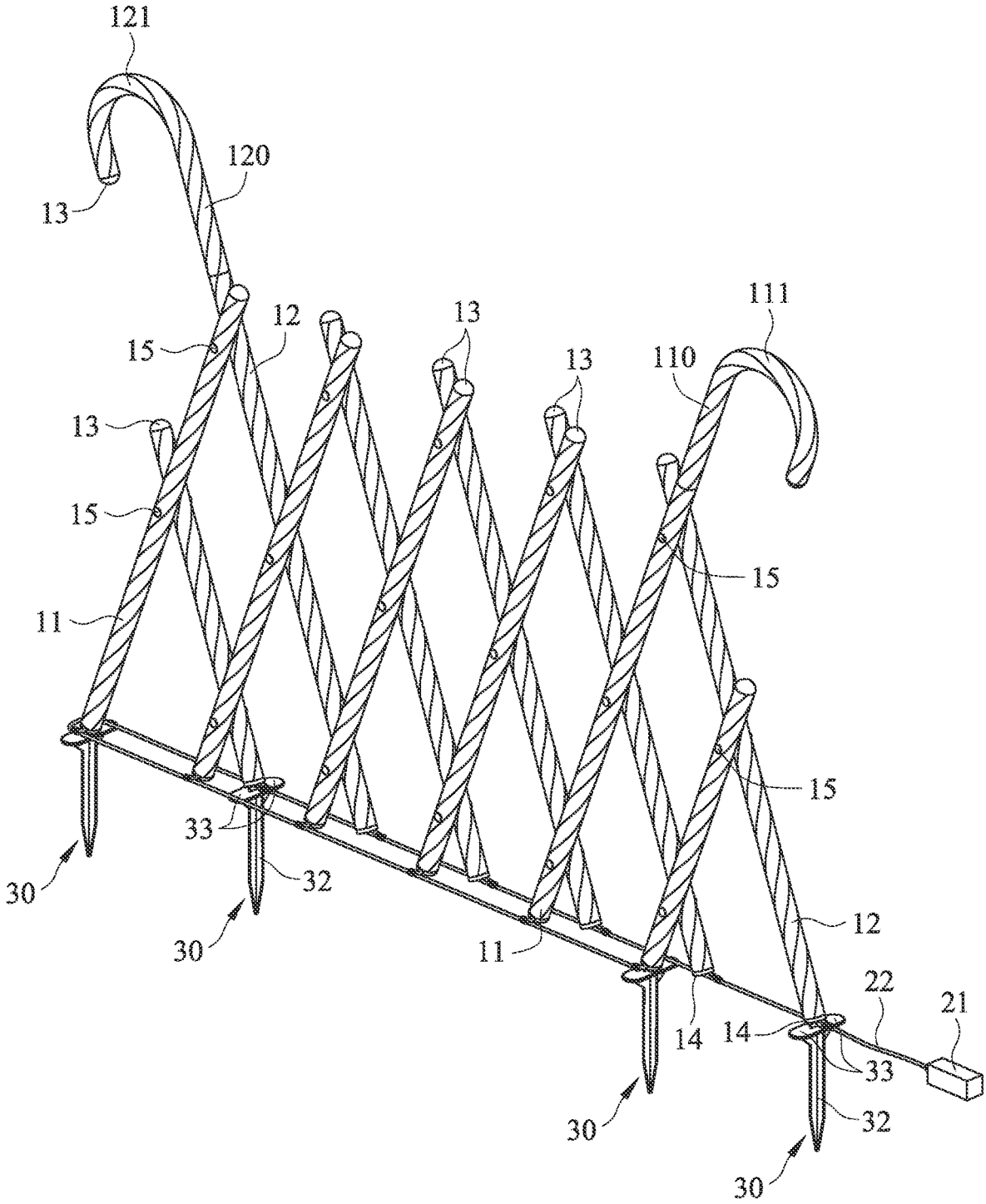
FIG. 7 shows an application of an embodiment of the invention, with stakes connected to the main body.

In this embodiment, referring to FIG. 6 and FIG. 7, each bottom sleeve 14 is provided with a concave or hollow joining portion 142 for connecting with, e.g., for insertion by, the joining section 31 of a stake 30. Each stake 30 includes a joining section 31 and an extension section 32 that are connected together. Each stake 30 also includes a lateral wing 33 extending from each of two opposite lateral sides. The joining section 31 of each stake 30 is configured to be coupled to the joining portion 142 of one bottom sleeve 14. Each extension section 32 extends from the corresponding joining section 31 at an inclination angle so that when the main body 10 is in the expanded state, the extension sections 32 of all the stakes 30 connected to the main body 10 can be generally parallel to one another, thereby allowing the user to position the stakes 30 by driving them into an earth-based ground in the same vertical direction. In this embodiment, the inclination angle between each extension section 32 and the corresponding joining section 31 is about 30 degrees. In one feasible embodiment, it is suitable for the inclination angle to range from 15 to 45 degrees. Thus, in addition to being used for indoor landscaping, the decorative light of the present invention can be connected with the desired/required number of stakes 30 at the bottom end in order to be used outdoors, e.g., in a garden. (In FIG. 7 for example, only an appropriate number of stakes 30 are connected at a number of appropriate positions respectively. In practice, however, it is feasible for each first elongated member 11 and each second elongated member 12 to be connected with a stake 30.) While positioning the stakes 30, the user may step on, and thereby add pressure to, either of the two lateral wings 33 of each stake 30 in order to drive the stake 30 into the ground with ease, the objective being for the stakes 30 in use to position and support the main body 10 securely.

According to the above, the decorative light applicable to landscaping as disclosed herein has a novel and exquisite design, serves both decorative and spatial-layout-defining purposes, and is a creation satisfying the patentability requirements. It should be understood, however, that the embodiments described above are only some preferred ones of the present invention. Any extension, modification, simple change, or equivalent substitution based on the technical means of the invention shall fall within the scope of the appended claims.

What is claimed is:

1. A decorative light applicable to landscaping, comprising:

an expandable and collapsible main body including a plurality of parallel first elongated members and a plurality of parallel second elongated members, wherein each said second elongated member as well as each said first elongated member has a hollow interior, the first elongated members are arranged obliquely with respect to, and overlap, the second elongated members, and the first elongated members and the second elongated members are pivotally connected by a plurality of pivot shaft members so as to be pivotally and slantingly movable with respect to each other, thereby allowing the main body to be expandable and collapsible between two opposite lateral sides of the main body; and a lighting portion including a power supply unit and a plurality of light strings, wherein the light strings are electrically connected to the power supply unit and extend into the first elongated members and the second elongated members respectively, and each said light string is provided with a plurality of light-emitting diode (LED) lamp beads arranged at intervals.

2. The decorative light applicable to landscaping as claimed in claim 1, wherein at least one of the first elongated members has a top portion connected or extended with a rotatable first handle, at least one of the second elongated members has a top portion connected or extended with a rotatable second handle, and when the main body is in a collapsed state, the first handle and the second handle are rotatable to jointly form a gripping portion.

3. The decorative light applicable to landscaping as claimed in claim 2, wherein each said second elongated member as well as each said first elongated member is provided with, and has a top end sealed by, a top cover, and each said top cover has an inner side provided with a positioning portion for securing a corresponding said light string.

4. The decorative light applicable to landscaping as claimed in claim 3, wherein the second handle as well as the first handle has a hollow interior, the first handle is connected between a corresponding said first elongated member and the top cover of the corresponding first elongated member, and the second handle is connected between a corresponding said second elongated member and the top cover of the corresponding second elongated member.

5. The decorative light applicable to landscaping as claimed in claim 2, wherein the first handle and the second handle are symmetrically located and are close to the two opposite lateral sides of the main body respectively, and each of the first handle and the second handle includes a backwardly curved arcuate section.

6. The decorative light applicable to landscaping as claimed in claim 5, wherein the LED lamp beads of each said light string are configured to emit light in a continuous or flashing manner when activated.

7. The decorative light applicable to landscaping as claimed in claim 6, wherein each said second elongated member as well as each said first elongated member has an outer surface provided with a design of at least two colors.

8. The decorative light applicable to landscaping as claimed in claim 5, wherein each said first elongated member is pivotally connected to at least two adjacent ones of the second elongated members, and each said second elongated member is pivotally connected to at least two adjacent ones of the first elongated members.

9. The decorative light applicable to landscaping as claimed in claim 8, wherein each said second elongated member as well as each said first elongated member has a bottom end coupled with a bottom sleeve, and each said bottom sleeve is formed with a lateral guide groove for allowing passage of a corresponding said light string.

10. The decorative light applicable to landscaping as claimed in claim 9, wherein each said second elongated member as well as each said first elongated member is provided with, and has a top end sealed by, a top cover, and each said top cover has an inner side provided with a positioning portion for securing a corresponding said light string.

11. The decorative light applicable to landscaping as claimed in claim 10, wherein the second handle as well as the first handle has a hollow interior, the first handle is connected between a corresponding said first elongated member and the top cover of the corresponding first elongated member, and the second handle is connected between a corresponding said second elongated member and the top cover of the corresponding second elongated member.

12. The decorative light applicable to landscaping as claimed in claim 11, wherein the lighting portion further includes an external electrical cable connected to the power supply unit, and each said light string is electrically connected to the power supply unit through the external electrical cable.

13. The decorative light applicable to landscaping as claimed in claim 12, wherein each said bottom sleeve is further provided with a joining portion for connecting with a stake; each said stake includes a joining section, an extension section, and two lateral wings; each said joining section is configured to be coupled to a said joining portion; each said extension section extends from a corresponding said joining section at an inclination angle in order for the extension sections of a plurality of said stakes connected to the main body to be generally parallel to one another when the main body is in an expanded state; and the two lateral wings of each said stake extend from two opposite lateral sides of the each said stake respectively.

14. The decorative light applicable to landscaping as claimed in claim 1, wherein each said first elongated member is pivotally connected to at least two adjacent ones of the second elongated members, and each said second elongated member is pivotally connected to at least two adjacent ones of the first elongated members.

15. The decorative light applicable to landscaping as claimed in claim 1, wherein each said second elongated member as well as each said first elongated member is provided with, and has a top end sealed by, a top cover, and each said top cover has an inner side provided with a positioning portion for securing a corresponding said light string.

16. The decorative light applicable to landscaping as claimed in claim 1, wherein each said second elongated member as well as each said first elongated member has a bottom end coupled with a bottom sleeve, and each said bottom sleeve is formed with a lateral guide groove for allowing passage of a corresponding said light string.

17. The decorative light applicable to landscaping as claimed in claim 16, wherein each said bottom sleeve is further provided with a joining portion for connecting with a stake.

18. The decorative light applicable to landscaping as claimed in claim 17, wherein each said stake includes a joining section and an extension section, each said joining section is configured to be coupled to a said joining portion, and each said extension section extends from a corresponding said joining section at an inclination angle in order for the extension sections of a plurality of said stakes connected to the main body to be generally parallel to one another when the main body is in an expanded state.

19. The decorative light applicable to landscaping as claimed in claim 18, wherein each said stake has two opposite laterals sides each extended with a lateral wing.

20. The decorative light applicable to landscaping as claimed in claim 1, wherein the lighting portion further includes an external electrical cable connected to the power supply unit, and each said light string is electrically connected to the power supply unit through the external electrical cable.

* * * * *